US010583332B1

(12) United States Patent
Calandro

(10) Patent No.: US 10,583,332 B1
(45) Date of Patent: Mar. 10, 2020

(54) METHOD OF MAKING TEXTURED SPORTS BALL

(71) Applicant: Christopher J. Calandro, Frisco, TX (US)

(72) Inventor: Christopher J. Calandro, Frisco, TX (US)

( * ) Notice: Subject to any disclaimer, the term of this patent is extended or adjusted under 35 U.S.C. 154(b) by 0 days.

(21) Appl. No.: 16/173,060

(22) Filed: Oct. 29, 2018

(51) Int. Cl.
*A63B 45/00* (2006.01)
*A63B 41/08* (2006.01)

(52) U.S. Cl.
CPC ..... *A63B 45/00* (2013.01); *A63B 41/08* (2013.01)

(58) Field of Classification Search
CPC ..... A63B 41/08; A63B 45/00; A63B 43/002
See application file for complete search history.

(56) References Cited

U.S. PATENT DOCUMENTS 1,931,429 A * 10/1933 Buckner ..... A63B 41/08 473/596
2,194,674 A * 3/1940 Riddell ..... A63B 41/08 473/597
D235,794 S * 7/1975 Kroener ..... D21/712
4,772,020 A * 9/1988 Martin ..... A63B 37/14 273/DIG. 20
5,069,935 A * 12/1991 Walters ..... A63B 41/08 273/334
D354,102 S * 1/1995 Lehman ..... D21/712
5,377,818 A * 1/1995 White ..... F16G 3/10 198/844.2
D375,129 S * 10/1996 Daicos ..... D21/712
5,779,578 A 7/1998 Calandro
5,984,812 A * 11/1999 Sassak ..... A63B 59/50 473/596
6,331,151 B2 12/2001 Calandro
D488,524 S * 4/2004 Johnson ..... D21/712
D491,240 S * 6/2004 Johnson ..... D21/712
D537,132 S * 2/2007 Barhoum ..... D21/712
7,758,458 B2 * 7/2010 Fujisawa ..... D06N 3/0077 473/597
9,802,082 B1 10/2017 Calandro
2001/0002378 A1 5/2001 Calandro
2005/0245335 A1 * 11/2005 Frisina ..... A63B 37/14 473/597
2006/0068951 A1 * 3/2006 Chang ..... A63B 41/08 473/605
2006/0105866 A1 * 5/2006 Ma ..... A63B 41/08 473/603
2006/0160644 A1 * 7/2006 Hu ..... A63B 41/10 473/603
2006/0211527 A1 * 9/2006 Guenther ..... A63B 41/08 473/597

(Continued)

*Primary Examiner* — Steven B Wong
(74) *Attorney, Agent, or Firm* — Law Office of William Gustavson, PC

(57) ABSTRACT

A sports ball (10), such as a football (12), has outer panels (14) of leather. The outer panels (14) have embossed pebbles (16) to enhance grip. Each outer panel (14) is formed by embossing the pebbles (16) on a segment (54) forming one or more of the outer panels (14) after the segment (54) has been cut from the unembossed full hide or half hide from which it comes. This provides great advantages in flexibility and consistency of manufacturing in addition to improved performance such as grip and aerodynamics.

2 Claims, 8 Drawing Sheets

(56) References Cited

U.S. PATENT DOCUMENTS

| | | | | |
|---|---|---|---|---|
| 2007/0060426 | A1* | 3/2007 | Maziarz | A63B 41/08 473/605 |
| 2010/0009792 | A1* | 1/2010 | Ashida | A63B 41/08 473/604 |
| 2012/0088614 | A1* | 4/2012 | Bulfin | A63B 41/08 473/604 |
| 2012/0144698 | A1* | 6/2012 | McDowell | B29D 35/146 36/45 |
| 2014/0100067 | A1* | 4/2014 | Swiszcz | A63B 41/08 473/603 |
| 2015/0367183 | A1* | 12/2015 | Ou | A63B 45/00 473/604 |
| 2018/0229461 | A1* | 8/2018 | Sermpongs | B29D 35/142 |

* cited by examiner

METHOD OF MAKING TEXTURED SPORTS BALL

TECHNICAL FIELD

This invention relates to sport balls such as footballs and basketballs, and in particular to the surface texture thereof.

BACKGROUND OF THE INVENTION

The outermost surface or covers of various sports balls, such as footballs and basketballs, are textured with protrusions or pebbles which are designed to create more friction and thus improve the gripability of the ball by the hands of the players using them. Most players consider grip to be a key element of their success. In general, the worse the grip of the sports balls, the worse the ball is believed to perform. When players of basketball and football in particular are unable to control and grip the ball, the result is usually believed to be bad for the player and the team in possession of the ball. Footballs and basketballs have a surface textured with protrusions or pebbles which are designed to create more friction and thus improve the grip. However, a need continues to exist to improve the grip of a sports ball to allow the player to better play the game.

These sports balls are often made with leather. Each hide of leather historically is stamped with a pebble texture in a random pattern, which, when cut into parts to build the sports balls, will result in a continuation of the random pebble texture regardless of the orientation of each part after assembly. The rules governing some sports require balls to be made with leather and stamped with a pebble grain. Older, worn out sports balls have less pebble depth due to wear and tear so balls with no or shallow pebble grain texture are not as desirable and believe to be at the end of its usefulness. A sports ball is believed to be better when the pebble grain is deeper and more defined. A deeper, more defined pebble embossing will result in a finished product that will last longer and is more desirable to athletes and players of a game.

Many leather finishers, processing plants or tanneries have very large hydraulic presses outfitted with metal embossing dies consisting of a negative three dimensional pattern of a randomly arranged pebble grain texture to be pressed into leather hides. Leather producers and finishers have embossed this pebble grain into the entire hide of leather using the random texture at tanneries for decades. The hydraulic press compresses the die into leather hides which leaves an impression in the hide when the die is released and separated from the leather. Then, the embossed hides are typically shipped to manufacturers who cut these hides into individual parts or panels to produce sports balls.

A full hide or half hide (also known as a side) of leather can be very large, depending upon the type and size of the animal used to produce the leather hide. A side of cowhide, for example, can be as large as 25 square feet or larger. A problem exists when hides are so large that each hide has to be partially stamped, moved and stamped again to emboss 100 percent of the surface of the hide. In this situation, a seam is visible on the finished surface of the leather which is considered undesirable in manufacturing. Often times, manufacturers avoid these seams and cut around them, which results in much lower cutting yield and an increase in production cost.

Another problem exists when stamping large hides. According to the laws of physics, when embossing or stamping leather, the larger the surface area to be embossed, the more force will be required to make the desired impression into the leather. So, hundreds of tons of force are needed to stamp large hides of leather with pebble grain. Since hides vary greatly depending upon the size and type of each animal, embossing depth is very inconsistent due to the size or surface area of each hide being stamped. This result is undesirable to any manufacturer that desires a deeper, more defined pebble in sports balls.

Further, certain areas of animal hides are comprised of more dense fibers than other areas. For example, the shoulder and back area of hides usually consists of harder, more dense fibers than the belly area which is normally softer and less dense. When an entire or partial hide is being embossed or compressed by the tannery, the dense grain will restrict the downforce of the die and result in less embossing in less dense parts of the hide that would normally be pressed more deeply since the fibers are softer and offer less resistance. Also, for the largest of the hides, existing machinery may lack the tonnage necessary to apply enough pressure for a deep, permanent embossed pebble grain texture. Therefore the hide is often times stamped unevenly or inadequately with pebble texture by the tannery. Then, when the manufacturer receives the undesirable hide and cuts it into parts or panels, the result is inconsistently embossed panels which are undesirable to users of the sports balls. Many times the manufacturer of sports balls is required to scrap or discount footballs with little or no pebble texture, which increases production costs.

Another problem exists when receiving hides pre-embossed by tanneries. Prior to foil stamping or printing manufacturer, brand and/or team logos, the pre-embossed pebble grain needs to be flattened or made smooth so foil, ink or a film transfer can be properly applied to the pre-embossed leather panels. In order to flatten the pre-embossed pebble grain in certain areas of a sports ball panel, tons of pressure and high heat are required to emboss a flat space or area for the manufacturer brand or team logo is necessary. Often times, so much pressure and heat is required that the pre-embossed leather sports ball panels will shrink, expand and/or curl which creates additional problem for manufacturers of sports balls. Further, the need to flatten the pebbles pre-embossed by a tannery adds an additional step in the manufacturing process which adds cost and potential defects.

SUMMARY OF THE INVENTION

In accordance with one aspect of the present invention, a sports ball is manufactured by cutting a selected segment from a full hide or half hide of tanned leather suitable for making a portion of at least one sports ball, subsequently embossing a surface of the selected segment of the leather and forming the sports ball from the embossed leather.

In accordance with another aspect of the present invention, a sports ball manufactured by this process forms the invention.

In accordance with another aspect of the present invention, a sports ball has a plurality of outer panels, the selected segment of the leather forming at least one outer panel of the sports ball.

In accordance with another aspect of the present invention, a sports ball has a plurality of outer panels, the selected segment of the leather forming all the outer panels of the sports ball.

In accordance with another aspect of the present invention, a sports ball has a plurality of outer panels, the selected segment of the leather forming at least one of the outer panels of the sports ball and embossed with a pattern unique to that outer panel.

In accordance with another aspect of the present invention, a sports ball has a plurality of outer panels, the selected segment of the leather forming at least one of the outer panels of the sports ball, the surface of said at least one outer panel only being partially embossed.

In accordance with another aspect of the present invention, a brand or logo is applied in the non-embossed portion of the outer panel In accordance with another aspect of the present invention, a sports ball has a plurality of outer panels, the selected segment of the leather forming at least one of the outer panels of the sports ball, the outer panel being embossed with an alignment pattern.

In accordance with another aspect of the present invention, the sports ball is a football.

BRIEF DESCRIPTION OF THE DRAWINGS

A more complete understanding of the invention and its advantages will be apparent from the following Detailed Description, taken in conjunction with the accompanying Drawings, in which.

DETAILED DESCRIPTION

Figure 1:
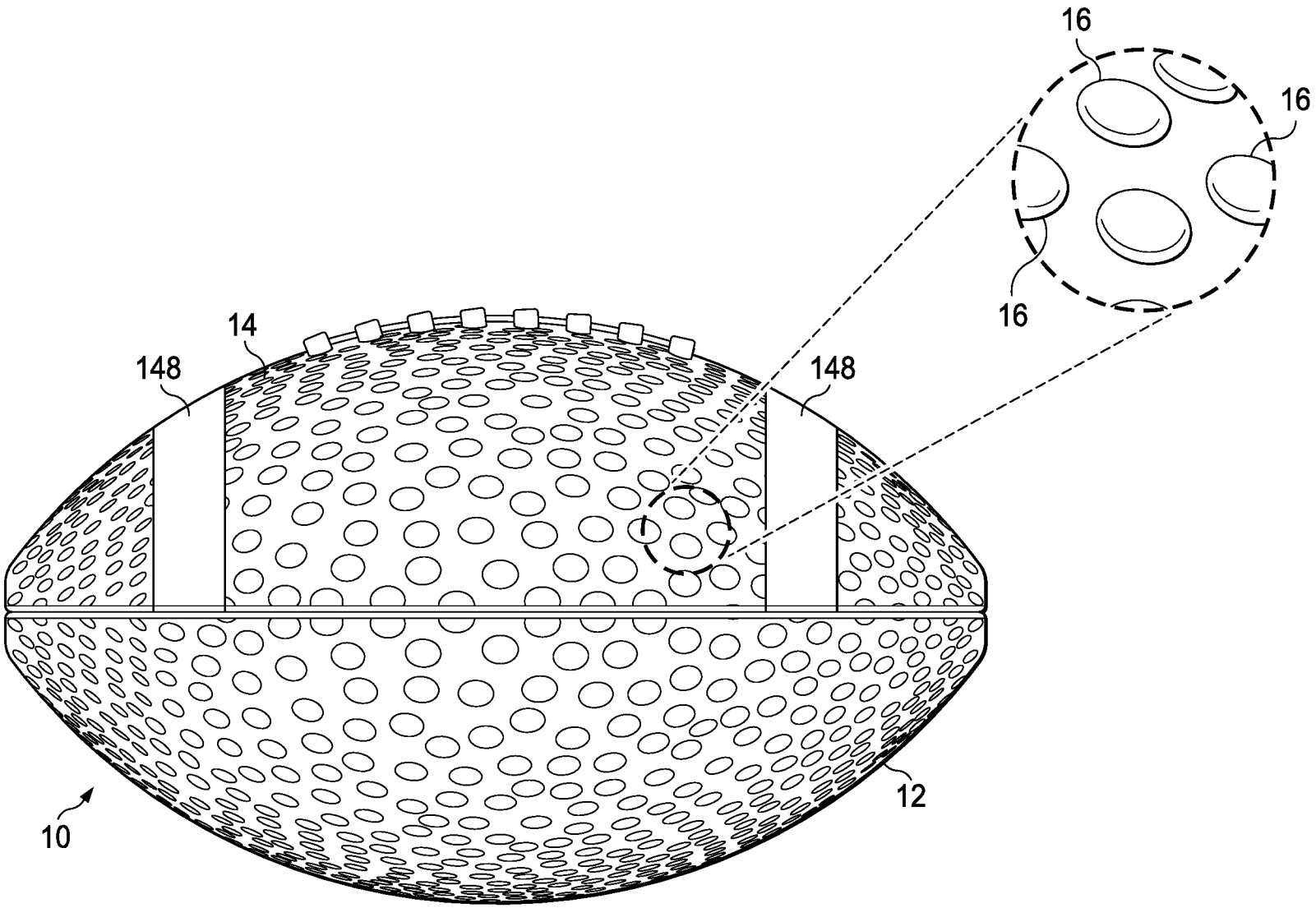
FIG. 1 is an illustration of a sports ball made in accordance with a first embodiment of the present invention.

With reference now to the figures, FIG. 1 illustrates a sports ball 10, in this case a football 12 made in accordance with the teaching of the present invention. Sports ball 10 could as readily be a basketball, or other ball used in sport play. As can be seen, the sports ball 10 has an outer surface or cover formed of one or more panels 14 that is textured by outward protrusions or pebbles 16 on the outer surface of panels 14. While the material of the panels 14, usually leather, rubber or materials with similar properties, has inherently good gripability, the use of pebbles 16 is intended to create enhanced friction and thus improve the gripability of the sports ball 10.

Figure 2:
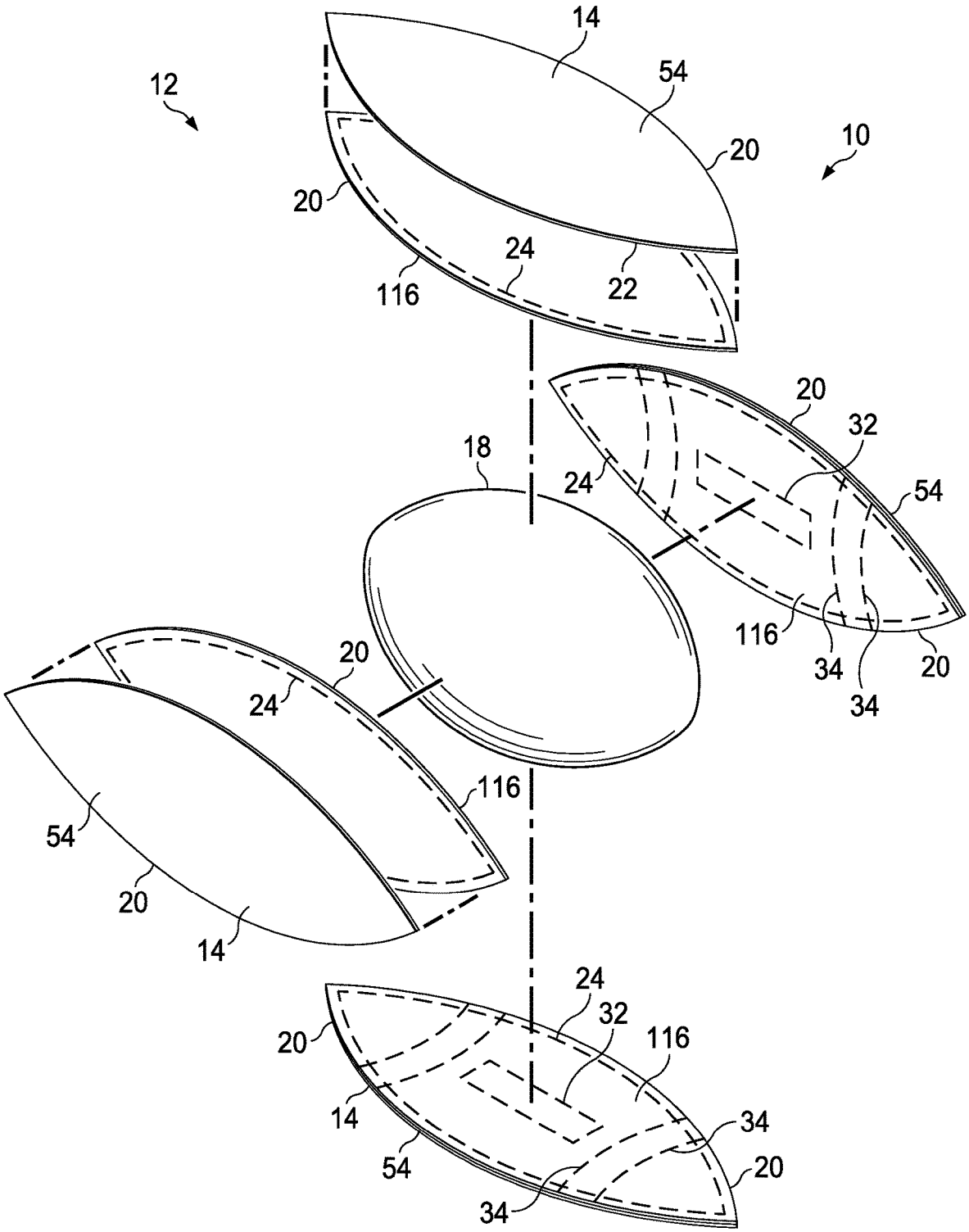
FIG. 2 is an exploded view of a sports ball of FIG. 1.

FIG. 2 illustrates the construction of football 12. Football 12 is formed of four outer leather or synthetic panels 14, four inner layers 116 of similar shape as the panels 14 and an air bladder 18. Each of the inner layers 116 is sewn, glued or laminated to the inside surface 22 of an outer panel 14. The inner layers 116 are generally the same shape and dimensions as the panels 14. The inner layers 116 are typically fabric reinforced by rubber, vinyl or polyurethane to add strength and weight to the football 12. The inner layers 116 and outer leather panels 14 are sewn together by thread 24 at their edges 20 to form the exterior of the football 12. Thread 32 can be used to attach a logo and threads 34 can be used to attach a white stripe 148, commonly used on footballs 12. The bladder 18 lies inside the football 12 and can be inflated to the desired air pressure for the football 12.

Figure 3A:
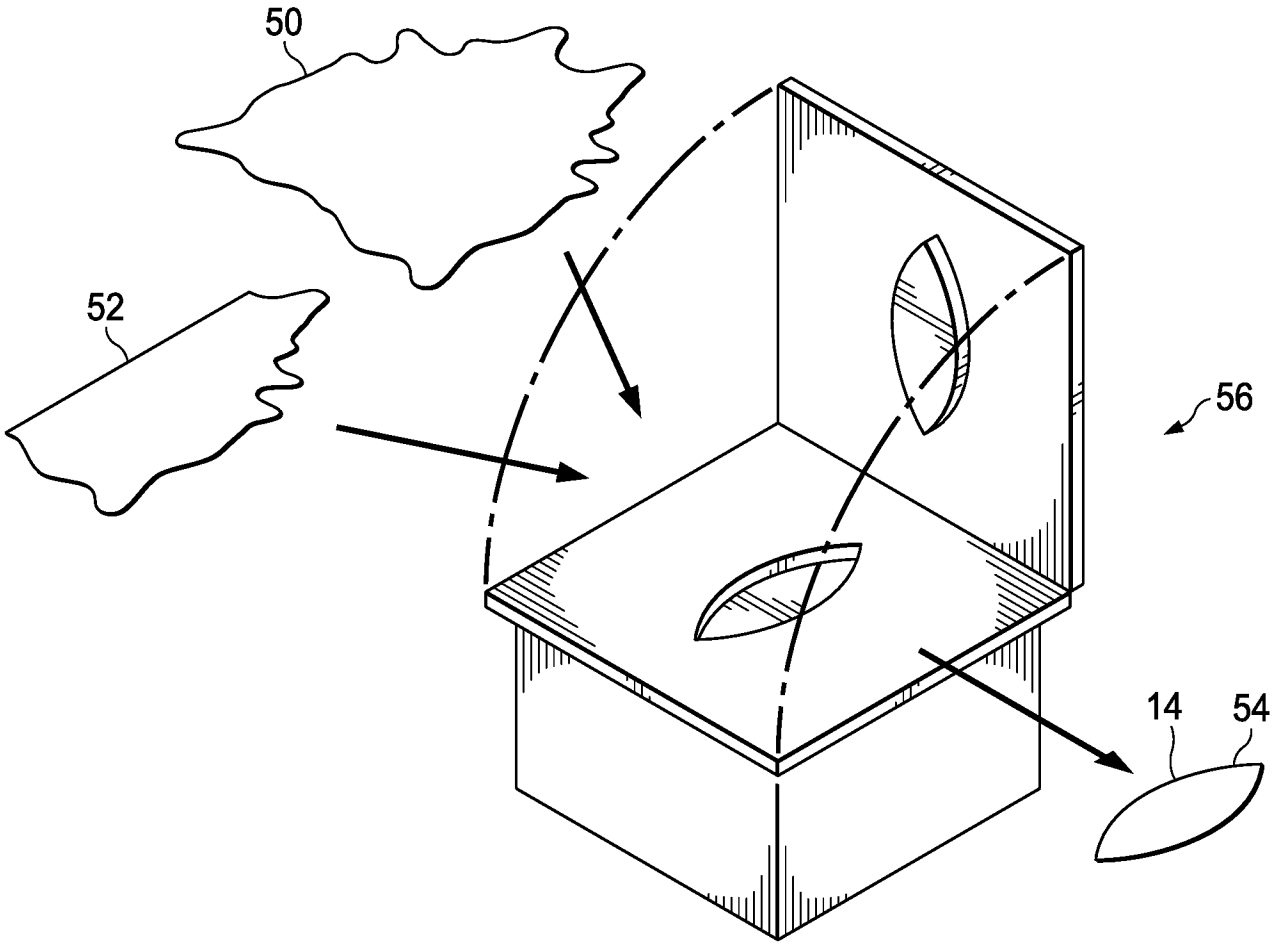
FIG. 3A is an illustration of cutting a segment of leather from a full hide or half hide prior to embossing to make a single ball panel.
Figure 3B:
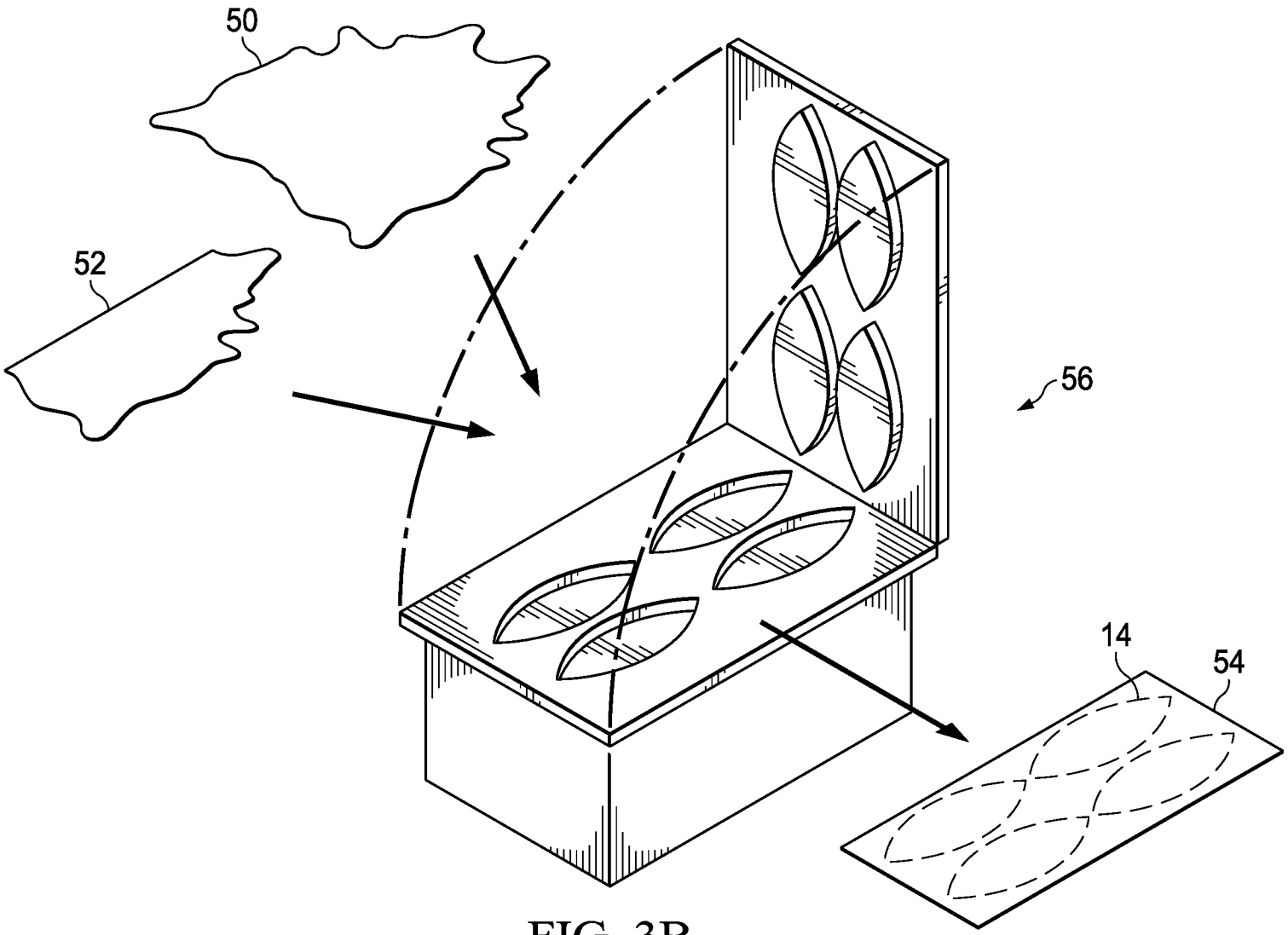
FIG. 3B is an illustration of cutting a segment of leather from a full hide or half hide prior to embossing to make multiple ball panels.

In this invention, the football 12 is manufactured in an improved process from a full hide 50 or half hide 52 of leather as seen in FIGS. 3A and 3B. The hides of leather would merely be tanned by the tannery, but not embossed with pebble grain texture. The manufacturer of the sports ball 10 would receive the hides that have not been embossed and then cut them into individual segments or parts 54 in a cutting machine 56 as seen in FIGS. 3A and 3B. Segment 54 can be the individual panel 14 of a football 12, for example, as seen in FIG. 3A, or could be large enough to comprise all four panels 14 of a football 12 as seen in FIG. 3B by later cutting the segment 54 into the four separate panels 14. Segment 54 could even be large enough to comprise enough leather to form panels 14 for multiple footballs 12.

Figure 4A:
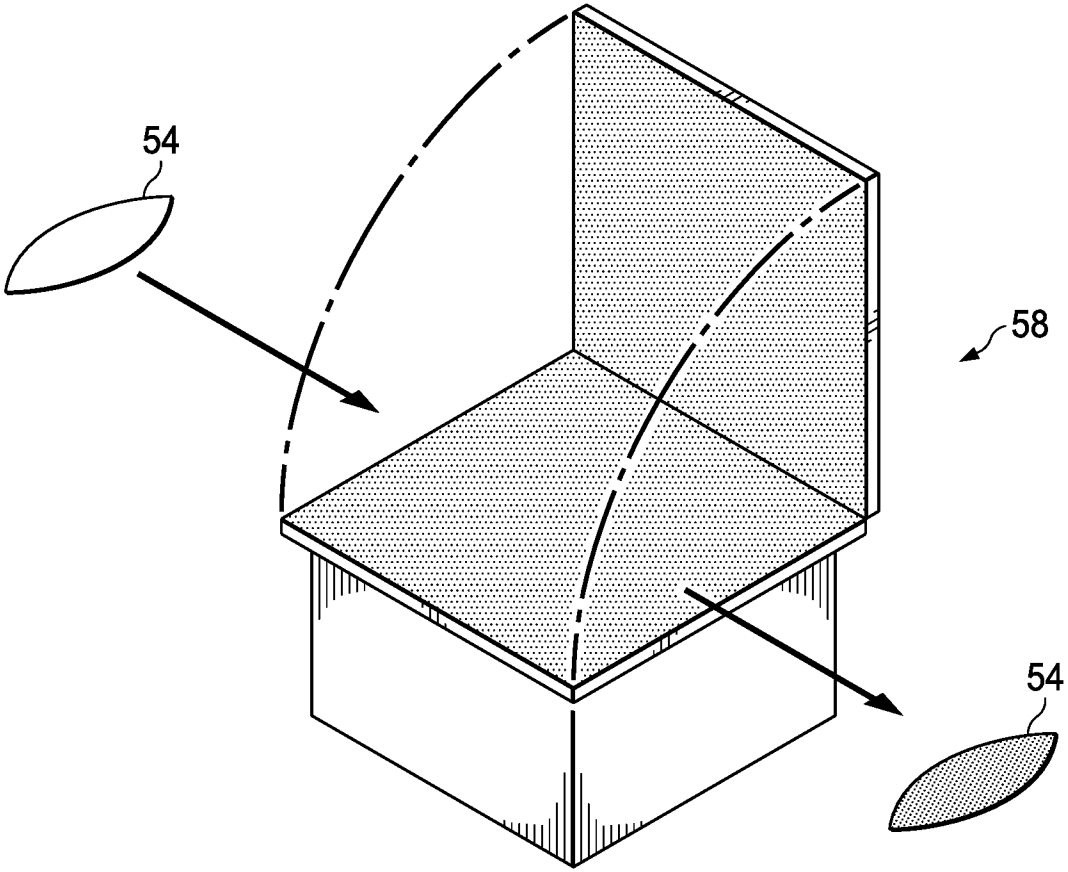
FIG. 4A is an illustration of embossing the cut segment of leather, the cut segment forming an outer panel of the sports ball.
Figure 4B:
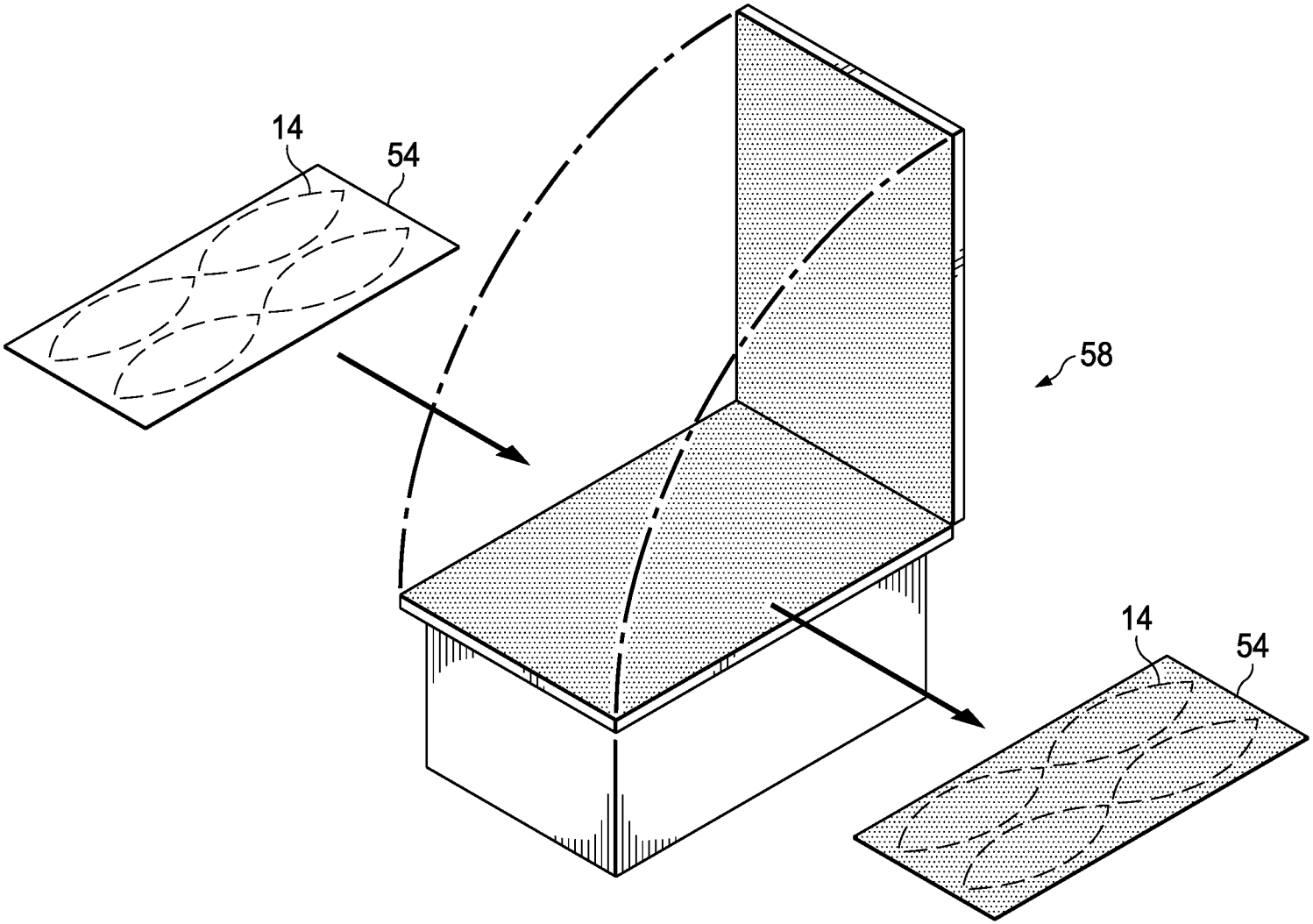
FIG. 4B is an illustration of embossing the cut segment of leather, the cut segment forming several outer panels of the sports ball.
Figure 5:
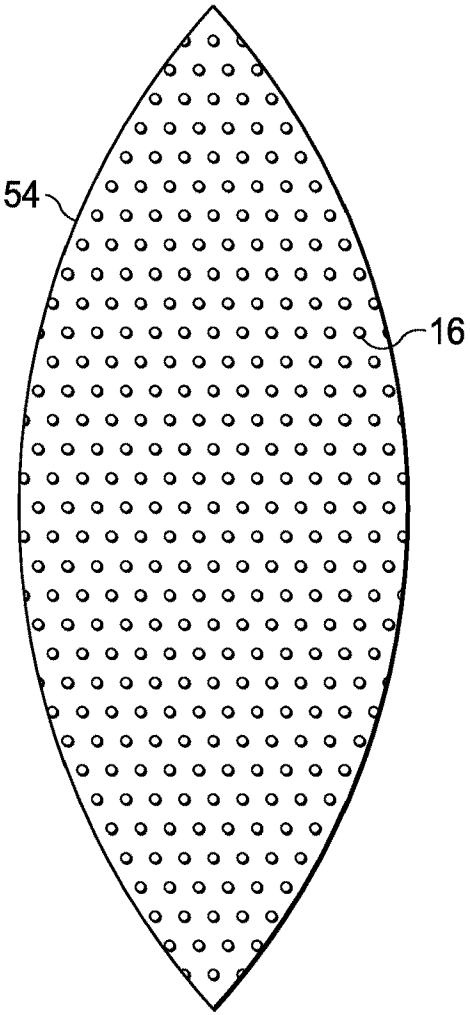
FIG. 5 is an illustration of the embossed outer panel having conventional pebbles.

After cutting, the segments 54 are embossed with a pebble grain or any other pattern of texture in an embossing machine 58 as seen in FIGS. 4A and 4B to create the embossed segment 54 as shown in FIG. 5. The panels 14 could be embossed one at a time by making segment 54 a single panel 14 as shown in FIG. 4A, or multiple panels 14 in a single segment 54 can be embossed simultaneously as seen in FIG. 4B. By exerting a similar amount of pressure used to stamp entire hides, but to one or multiple panels 14 of the sports ball 10, the result will be a deeper, more permanent and more consistent indentation into each panel 14. In this invention, manufacturers of sports balls could use more, less or the same pressure as tanneries to emboss one or multiple panels 14 of a pre-assembled sports ball 10.

Further, since the segments 54 stamped individually by a sports ball manufacturer would be cut from the same area of the hide, each panel 14 contained in the segment 54 being stamped will be either dense or less dense fibers and therefore will be embossed more consistently. There would be no restriction of embossing pressure from more dense areas of the hide as noted.

Also, by using this invention, the undesirable embossing seam mentioned above would be eliminated. Since each part or segment 54 being embossed is significantly smaller than the entire hide, the pebble grain or other texture would be embossed in a continuous pattern without a seam. This invention would greatly increase cutting yield since there would be no embossing seam to avoid.

Figure 6B:
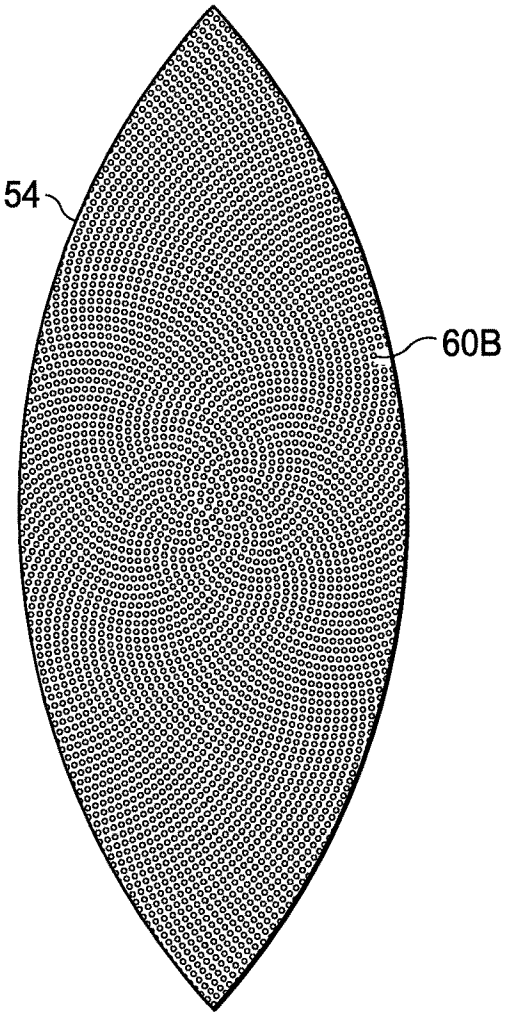
FIGS. 6A and B are illustrations of the embossed outer panel having unique patterns embossed to enhance performance.
Figure 6A:
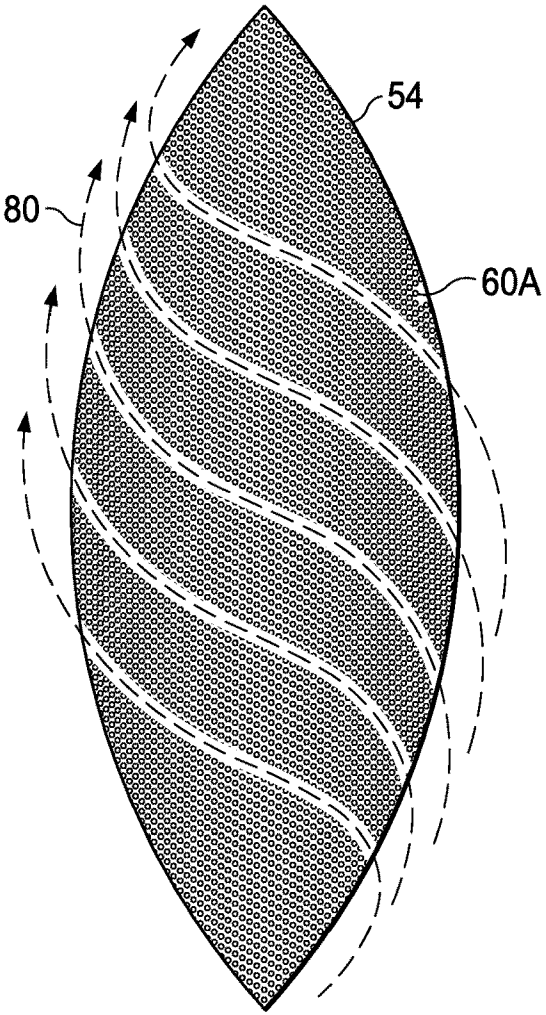

With reference to FIGS. 6A and 6B, since the pebble grain or texture is embossed after the segment 54 has been cut to shape, instead of the random pattern tanneries use when stamping an entire hide, now the pebbles can be positioned or shaped in a way that compliments the construction, appearance or performance such as grip and aerodynamics of each sports ball. In FIG. 6A, pebbles 60A are organized in a way that enhances airflow, thus improving the spin or spiral of football 14. The pebbles 60A are aligned along a spiral direction, as indicated by arrows 80, corresponding to the flow of air over the football 14 when thrown with a proper spiral. Thus, the air flow over the surface of the spiraling football 14 would encounter alternating rows of pebbles 60A and intervening paths with no pebbles 60A, which should reduce the drag on the football 14 as it is thrown and thus increase the distance it is thrown. In FIG. 6B pebbles 60B are arranged in a Fibonacci series spiral pattern to enhance airflow. Improved aerodynamics results in tighter spirals which improves the way a sports ball 10 performs, particularly the distance and accuracy when throwing a football 12.

Another advantage of this invention is the pebbles could easily be altered since the stamping die in the stamping machine 58 is markedly smaller and less expensive to produce. Thus, the pebbles could be made larger or smaller or reconfigured to satisfy a particular customer or sports league. Further, the embossing texture could be easily changed completely to an unlimited possibility of textures, shapes, patterns and logos, or some combination of these.

Figure 7:
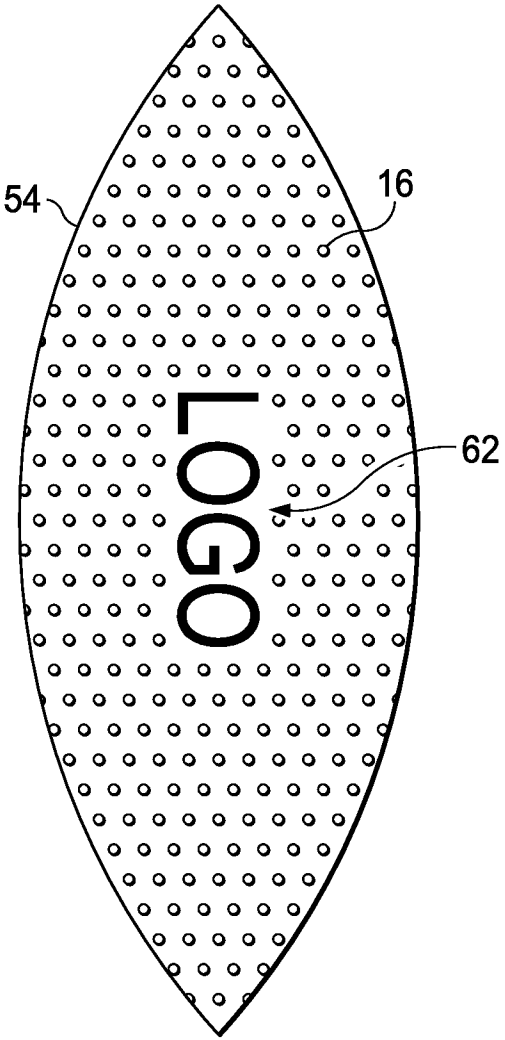
FIG. 7 is an illustration of the embossed outer panel having only a portion embossed and a brand or logo in the non-embossed portion.

Most sports leagues and organizations allow manufacturer and team logos to be stamped into sports balls 10. In football, it is preferred to have team logos stamped into each ball since the team on offense is allowed to use the ball of their choice, as long as it complies with official rules and specifications. By having team logos stamped into the leather, it is obvious to game officials and team representatives to which team the sports ball belongs. As seen in FIG. 7, another advantage of this invention is that the team and manufacturer brands and logos 62 can be stamped on the leather prior to embossing with pebble grain or any other texture. Traditionally, the tannery would emboss the leather with pebble grain and ship it to manufacturers of sports balls. The manufacturers would need to cut the hide into parts, then use very high pressure and very high heat to flatten the pebble grain embossed by the tannery so that brand and team logos could be cleanly stamped into the panels by a hot-foil stamp or thermal, heat transfer or printing process. The hot-stamp foil process or heat transfer or printing process usually requires the leather to have a flat, even surface to accomplish a clean stamp or transfer with high resolution. In this invention, the leather would be received from the tannery already flat and even. Using this invention, the finished sports ball will feature team, manufacturer or other brands or logos 62 with the same pebble grain texture as the rest of the leather part or panel. This would improve the appearance and performance of the logos that presently exist on sports balls.

Figure 8:
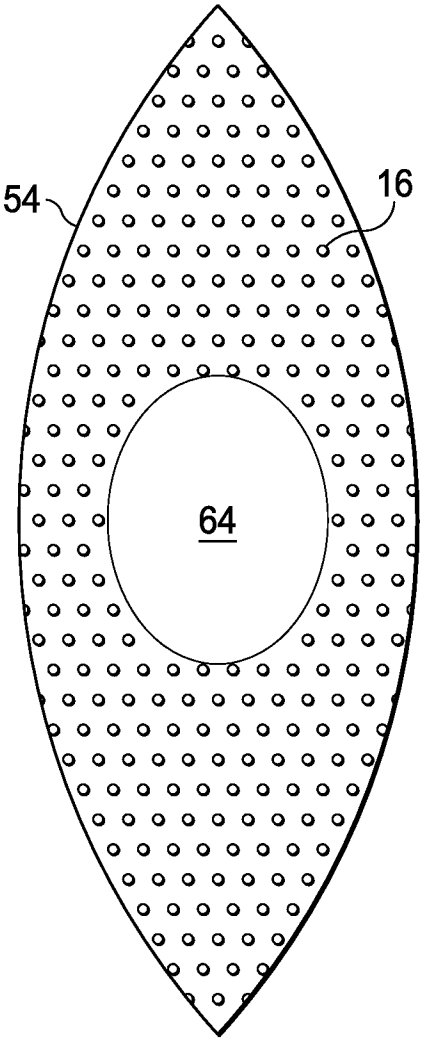
FIG. 8 is an illustration of the embossed outer panel having only a portion embossed and a different application in the non-embossed portion.

As seen in FIG. 8, segment 54 can be embossed only in a partial area thereof with pebble grain or other texture but leave other areas 64 without embossing. These unembossed flat areas could be raised further with additional pebbles or texture by applying a film, a screen or digital print or thermal heat transfer process. The additional pebbles can make the raised area even taller or more decorative, especially if printed with an expandable or puffy ink. This technique could be used to add faux stitching or dimension to logos or stripes.

Figure 9:
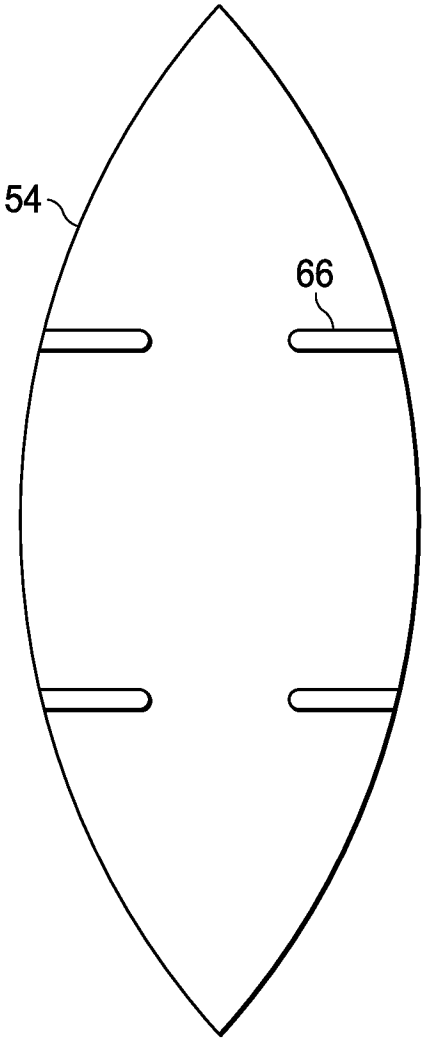
FIG. 9 is an illustration of the embossed outer panel having an alignment pattern.

As seen in FIG. 9, when stitching a sports ball, a problem exists when aligning the adjacent panels, such as panels 14 shown in FIG. 1, prior to assembly. Holding panels, such as the panels 14, together is difficult prior to or during their being permanently joined by stitching or any other method. Often times the person assembling the sports ball is unable to hold the parts in their proper position and joins the parts out of alignment with each other. It is crucial to creating an acceptable product that the parts being joined are positioned exactly in a manner that matches them perfectly to each other. In another advantage of this invention, an alignment mark or pattern 66 can be embossed into the outer edge of the segments 54 that provides visual guidance to properly align adjacent pieces together such that they fit each other and are less likely to move out of position.

While several embodiments of the present invention have been illustrated in the accompanying drawings and described in the foregoing Detailed Description, it will be understood that the invention is not limited to the embodiments disclosed, but is capable of numerous rearrangements, modifications and substitutions of parts and elements without departing from the scope and spirit of the invention.

The invention claimed is:

1. A method of making a football formed by four outer panels sewed together at their edges from a full hide or half hide of unembossed tanned leather, the hide having variation in density between at least a first density and a second density, comprising the steps of:

cutting the four outer panels from the full hide or half hide of unembossed tanned leather suitable for making the football, the unembossed leather having a surface, leaving a remainder of the full hide or half hide;

sorting the four outer panels by density to create at least a first group of outer panels of first density and a second group of second density;

subsequently embossing the surfaces of the outer panels of the first group with a first predetermined pressure to form pebbles on the surfaces to make the surfaces suitable for sports play with the football and embossing the surfaces of the outer panels of the second group with a second predetermined pressure to form pebbles on the surfaces to make the surfaces suitable for sports play with the football, with the first and second predetermined pressures being adjusted relative each other to ensure the pebbles on both the outer panels of the first group and the second group are uniform; and assembling the four outer panels to form the football.

2. The football formed by the method of claim 1.

* * * * *